US006039374A

United States Patent [19]

Klein

[11] Patent Number: 6,039,374

[45] Date of Patent: Mar. 21, 2000

[54] SUSPENDED COUPLING FOR LIFTING DEVICES, PARTICULARLY FOR PICKING UP AND DEPOSITING THERMAL INSULATION HOODS

[75] Inventor: Dieter Klein, Siegen, Germany

[73] Assignee: SMS Schloemann-Siemag Aktiengesellschaft, Düsseldorf, Germany

[21] Appl. No.: 09/115,801

[22] Filed: Jul. 15, 1998

[30] Foreign Application Priority Data

Jul. 16, 1997 [DE] Germany ..... 297 12 552 U

[51] Int. Cl.[7] ..... B66C 1/28

[52] U.S. Cl. ..... 294/67.31; 294/81.61; 294/88

[58] Field of Search ..... 294/67.31, 88, 294/81.51, 81.61, 81.56, 68.3; 414/626

[56] References Cited

U.S. PATENT DOCUMENTS

| | | | |
|---|---|---|---|
| 3,257,142 | 6/1966 | Barry | 294/81.51 |
| 3,306,646 | 2/1967 | Flora, Jr. | 294/81.61 |

FOREIGN PATENT DOCUMENTS

| | | | |
|---|---|---|---|
| 768524 | 10/1967 | Canada | 294/81.61 |
| 630191 | 9/1978 | U.S.S.R. | 294/81.61 |
| 1136935 | 1/1985 | U.S.S.R. | 294/88 |
| 1449510 | 1/1989 | U.S.S.R. | 294/68.3 |
| 1576466 | 7/1990 | U.S.S.R. | 294/81.56 |
| 1720986 | 3/1992 | U.S.S.R. | 294/67.31 |

*Primary Examiner*—Dean J. Kramer
*Assistant Examiner*—Paul T. Chin
*Attorney, Agent, or Firm*—Friedrich Kueffner

[57] ABSTRACT

A suspended coupling for lifting devices, particularly for picking up and depositing thermal insulation hoods from and over wire coils, includes a crossbeam to each end of which is connected a double-armed lever pair in an articulated manner and in a mirror-inverted manner relative to each other, wherein one lever arm pair is connected above the crossbeam through connecting rods to the lifting device, and wherein the other lever arm pair has hook-shaped ends underneath the crossbeam, wherein the hook-shaped ends can be coupled to support projections arranged on the upper side of the thermal insulation hood after the hook-shaped ends have been pivoted toward each other by a pulling movement transmitted to the lever pair by the lifting movement of the connecting rods. Arranged on the crossbeam and the upper lever arm pair are oppositely located pull-type electromagnets and corresponding armatures, wherein, in the switched-on pulling position, the electromagnets and armatures lock the upper lever arm pair against pivoting relative to the crossbeam and hold the hook-shaped ends of the lower lever.

3 Claims, 1 Drawing Sheet

SUSPENDED COUPLING FOR LIFTING DEVICES, PARTICULARLY FOR PICKING UP AND DEPOSITING THERMAL INSULATION HOODS

BACKGROUND OF THE INVENTION

1. Field of the Invention

The present invention relates to a suspended coupling for lifting devices, particularly for picking up and depositing thermal insulation hoods from and over wire coils.

2. Description of the Related Art

Thermal insulation hoods, as they are used following continuous high-capacity rolling mill trains in order to cover in an insulating manner the wire coils formed in rapid succession by wire windings placed on top of each other and are still hot prior to their further transport, were in the past grasped and coupled by crane trolleys or similar lifting devices by means of suspended gear which was conventionally provided on these lifting devices, were lowered over the wire coils, and were subsequently further transported after being uncoupled from the gear.

The coupling and uncoupling procedures of the thermal insulation hoods with the suspended gear required experienced operating personnel and also required a relatively large amount of time because the upper side of the thermal insulation hoods, depending on the construction and manner of operation of the devices for forming the coils, were more or less easily accessible and the radiation heat of the hot coils also made the work difficult.

SUMMARY OF THE INVENTION

Therefore, it is the primary object of the present invention to eliminate the difficulties described above and to make it possible to reduce the personnel required for coupling and uncoupling the suspended gear with the thermal insulation hoods.

In accordance with the present invention, to each end of a crossbeam is connected a double-armed lever pair in an articulated manner and in a mirror-inverted manner relative to each other, wherein one lever arm pair is connected above the crossbeam through connecting rods to the lifting device, and wherein the other lever arm pair has hook-shaped ends underneath the crossbeam, wherein the hook-shaped ends can be coupled to support projections arranged on the upper side of the thermal insulation hood after the hook-shaped ends have been pivoted toward each other by a pulling movement transmitted to the lever pair by the lifting movement of the connecting rods. Arranged on the crossbeam and the upper lever arm pair are oppositely located pull-type electromagnets and corresponding armatures, wherein, in the switched-on pulling position, the electromagnets and armatures lock the upper lever arm pair against pivoting relative to the crossbeam and hold the hook-shaped ends of the lower lever arm pair out of coupling position with the support projections of the thermal insulation hood.

In accordance with another feature of the present invention, alignment elements can be arranged at the bottom side of the crossbeam and the upper side of the thermal insulation hood, wherein the alignment elements releasably engage into each other when the crossbeam is placed on the thermal insulation hood. These alignment elements may be composed of downwardly directed conically shaped projections arranged at the bottom side of the crossbeam and corresponding upwardly open conically shaped recesses and possibly lateral funnel-shaped inclined guide plates on the upper side of the thermal insulation hood.

The arrangement and configuration of the suspended coupling for thermal insulation hoods according to the present invention make it possible, after the suspension coupling has been lowered over the thermal insulation hood on the upper side thereof, to align the suspension coupling relative to the upper side of the thermal insulation hood, to couple the suspension coupling to the thermal insulation hood and to once again lift up the suspension coupling without requiring any operator manipulations except for switching on and switching off the electromagnets.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
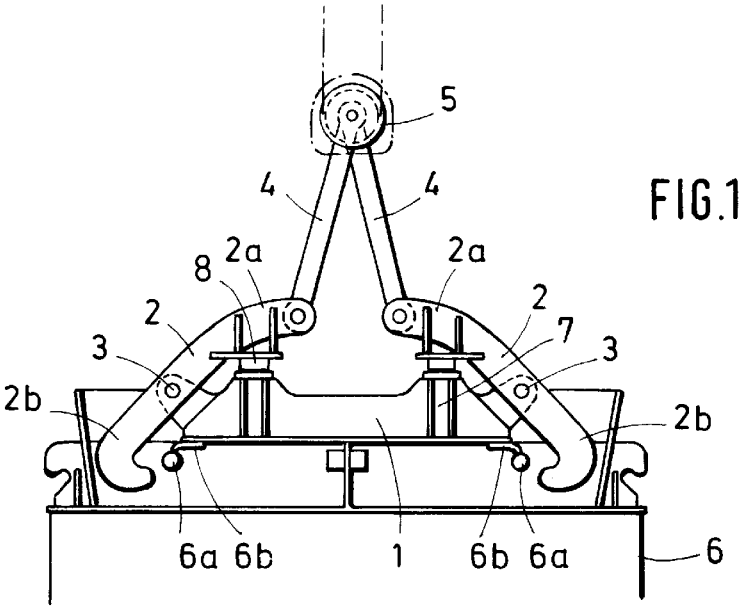
FIG. 1 is a side view of the suspension coupling according to the present invention, shown in the open position.

As illustrated in FIG. 1 of the drawing, the two-arm levers 2 of a lever pair are hinged at bearings 3 to the two ends of a crossbeam 1. The ends of the upper lever arm pair 2*a* above the crossbeam 1 are connected in an articulated manner through connecting rods 4 to the lifting device 5. The ends of the lower lever arm pair 2*b* are hook-shaped. The hook-shaped ends are located opposite support projections 6*a* which are arranged on the thermal insulation hood 6.

Figure 2:
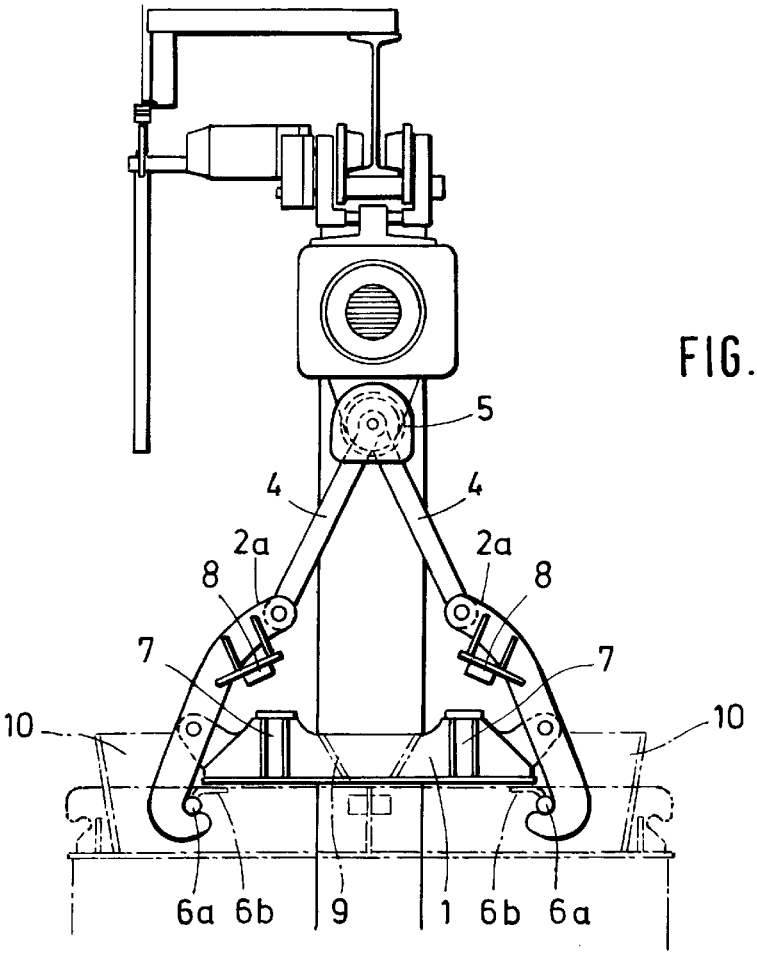
FIG. 2 is a side view of the suspension coupling of FIG. 1 shown in the coupling position.

As also shown in FIG. 2, pull-type electromagnets 7 are arranged on the upper side of the crossbeam 1 and corresponding armatures 8 are arranged underneath the upper lever arm pair 2*a*. Moreover, in the area of the support projections 6*a* on the upper side of the thermal insulation hood 6, support members 6*b* are provided for placing the crossbeam 1 thereon, and lateral guide plates 10 inclined in a funnel-shaped manner as well as upwardly open conically shaped recesses 9 are provided.

In operation, the suspended coupling is lowered by the lifting device 5 with the double arm lever 2 being in the position shown in FIG. 1 and the electromagnets 7 being switched on onto the upper side of the thermal insulation hood 6, such that the crossbeam 1 is lowered onto the support members 6*b* at the upper side of the thermal insulation hood 6. In that position, the hook-shaped ends of the lower lever arm pair 2*b* are located opposite the support projections 6*a*. The alignment of the crossbeam 1 in this position takes place by means of the afore-mentioned guide plates 10 or conical recesses 9 engaging in corresponding elements, not shown, at the crossbeam 1. After switching off the electromagnets 7 and pulling up the lifting device 5, the double arm levers 2 pivot into the position illustrated in FIG. 2, so that the ends of the lower lever arm pairs 2*b* engage in the support projections 6*a* and, consequently, provide the coupling between the crossbeam 1 and the thermal insulation hood 6.

After later putting down the thermal insulation hood 6 or placing the thermal insulation hood 6 on a roller conveyor, not shown, the double arm levers are moved back again into the position shown in FIG. 1 as a result of the so-called slack rope effect and can be held in this position by switching on the magnets 7, so that another coupling process can be started.

The invention is not limited by the embodiments described above which are presented as examples only but can be modified in various ways within the scope of protection defined by the appended patent claims.

I claim:

1. A suspended coupling for lifting devices for picking up thermal insulation hoods from wire coils and for placing thermal insulation hoods over wire coils, the coupling comprising a crossbeam having ends, and double arm lever pairs pivotally hinged in a mirror-inverted manner to the ends of the crossbeam, wherein each lever pair comprises an upper first lever arm pair located above the crossbeam and adapted to be connected through connecting rods to the lifting device, and a second lever arm pair located below the crossbeam and having hook-shaped ends, wherein the hook-shaped ends are adapted to be coupled to support projections arranged at an upper side of the thermal insulation hood by moving the hook-shaped ends toward each other by a pulling movement transmitted to the double lever pair by lifting the connecting rods, further comprising pull-type electromagnets and corresponding armatures, wherein the pull-type electromagnets are mounted on the crossbeam and the armatures are respectively mounted on both lever arms of the upper first lever arm pair opposite the pull-type electromagnets, wherein, in a switched-on pulling position, the electromagnets and the armatures hold the upper lever arm pair and the crossbeam in a locked position relative to each other and hold the hook-shaped ends of the lower lever arm pair out of the coupling position from the support projections.

2. The suspended coupling according to claim 1, further comprising alignment elements mounted at a bottom side of the crossbeam and the upper side of the thermal insulation hood, wherein the alignment elements are configured to be releasably engaged when the crossbeam is placed on the thermal insulation hood.

3. The suspended coupling according to claim 2, wherein the alignment elements are comprised of downwardly directed conically shaped projections arranged at the bottom side of the crossbeam and corresponding upwardly open conically shaped recesses on the thermal insulation hood, and guide plates mounted in a funnel-like configuration on the upper side of the thermal insulation hood.

* * * * *